US005454250A

United States Patent [19]

Ikeda et al.

[11] Patent Number: 5,454,250

[45] Date of Patent: Oct. 3, 1995

[54] METHOD FOR CONTROLLING DIE-RETAINING FORCE OF EXTRUDER

[75] Inventors: Fumio Ikeda, Kurobe; Akira Funai, Toyama; Tatsuyoshi Miyazaki, Kurobe, all of Japan

[73] Assignee: Yoshida Kogyo K.K., Tokyo, Japan

[21] Appl. No.: 168,997

[22] Filed: Dec. 20, 1993

[30] Foreign Application Priority Data

Dec. 21, 1992 [JP] Japan ..... 4-340275

[51] Int. Cl.[6] ..... B21C 31/00

[52] U.S. Cl. ..... 72/271; 72/272

[58] Field of Search ..... 72/23, 253.1, 271, 72/272

[56] References Cited

FOREIGN PATENT DOCUMENTS 2814525 10/1978 Germany ..... 72/272

251610 9/1992 Japan ..... 72/272

*Primary Examiner*—Lowell A. Larson

*Attorney, Agent, or Firm*—Hill, Steadman & Simpson

[57] ABSTRACT

A method and apparatus for controlling the die-retaining force of an extruder is disclosed. In the operation of an extruder adapted to retain a die with a container actuated by a container cylinder and effect extrusion of a billet readied for use in the container by forcing the billet through the die, to keep the die-retaining force of the extruder constant, the control of the die-retaining force of the extruder is carried out by causing the container cylinder to impart to the container a force directed away from the die so as to be sequentially decreased during the first half period of the extrusion and causing the container cylinder to impart to the container a force directed toward the die so as to be sequentially increased during the last half period of the extrusion.

7 Claims, 8 Drawing Sheets

METHOD FOR CONTROLLING DIE-RETAINING FORCE OF EXTRUDER

BACKGROUND OF THE INVENTION

1. Field of the Invention

This invention relates to a method for controlling the force with which the peripheral part of a die is retained in an extruder.

2. Description of the Prior Art

In the conventional extruders, the extruder constructed as shown in FIG. 1, for example, has been renowned. This extruder 1 comprises a platen 2, a pair of container cylinders 8*a* and 8*b* fitted into depressed parts 2*a* and 2*b* of the platen 2 respectively, and a container 15. One end of each of piston rods 13*a* and 13*b* of pistons 14*a* and 14*b* slidably inserted in the container cylinders 8*a* and 8*b* respectively is fixed to the container 15, a die 7 is attached through the medium of a sub-bolster 3, a bolster 4, a backer 5, and a die ring 6 to the platen 2, and the die 7 is consequently retained by causing the container cylinders 8*a* and 8*b* attached to the platen 2 to press the container 15 through the medium of a spreader 16 to the die 7. A billet 17 accommodated in the container 15 is pressed by a stem or ram 19 through the medium of a dummy block 18 and then extruded through an orifice 7*a* of the die 7 to be converted into an extruded article of a prescribed shape.

In the extruder of this kind, for the purpose of precluding possible leakage of the billet 17 through the contact surface between the inner circumferential edge part 15*a* of the container 15 and the spreader 16, namely the container seal surface, in the process of extrusion, the container seal surface is sealed by causing the container 15 to be moved toward the platen 2 and pressed against the spreader 16 by means of the container cylinders 8*a* and 8*b* and the peripheral part of the die 7 is retained by pressing the die 7 against the backer 5 with the sealing force censequently produced. The force which retains the die 7 inside the extruder equals the sealing force mentioned above and this sealing force is fixed by the propelling force of the container cylinders 8*a* and 8*b*, namely by the pressure of fluid supplied to chambers 9*a* and 9*b* and the area exposed to the pressure. The extrusion is carried out while the sealing force mentioned above is maintained at a constant magnitude by virtue of the size of the die 7 or the pressing force of the stem 19.

When section articles of aluminum were produced by extruding aluminum ingots by the use of this extruder and then tested to find their section thicknesses, the results of the test indicate that the section articles sequentially emanating from the extruder showed a gradual decrease in section thickness from the initial stage of extrusion onward and an abrupt decrease in section thickness immediately before the butt end and that the amount of variation in section thickness was in the approximate range of 0.1 to 0.12 mm.

SUMMARY OF THE INVENTION

It is, therefore, an object of the present invention to provide a method for controlling the die-retaining force of an extruder, which method enables the retaining force imposed on the peripheral part of a die to remain constant from the beginning to the end of extrusion without respect to the length of a billet being used thereby minimizing the variation of an extruded article in section thickness.

Another object of the present invention is to provide an extrusion process and apparatus for producing an extruded article which has a relatively uniform section thickness throughout the entire length.

To keep the die-retaining force of the extruder constant thereby minimizing the variation of the extruded article in section thickness, in accordance with the present invention, in the operation of an extruder adapted to retain a die with a container actuated by a container cylinder and effect extrusion of a billet readied for use in the container by forcing the billet through the die, the control of the die-retaining force of the extruder is carried out by causing the container cylinder to impart to the container a force directed away from the die so as to be sequentially decreased during the first half period of the extrusion and causing the container cylinder to impart to the container a force directed toward the die so as to be sequentially increased during the last half period of the extrusion.

BRIEF DESCRIPTION OF THE DRAWINGS

Other objects, features, and advantages of the invention will become apparent from the following description taken together with the drawings, in which.

DETAILED DESCRIPTION,OF THE PREFERRED EMBODIMENTS

As mentioned hereinbefore, an extruded article produced by the conventional extrusion process exhibits a gradual decrease in section thickness from the leading end to the trailing end thereof. The present inventors, after making various tests and researches on profiles extruded by an extruder as to the ununiformity in section thickness, have been ascertained that the this ununiformity is caused as follows.

Figure 1:
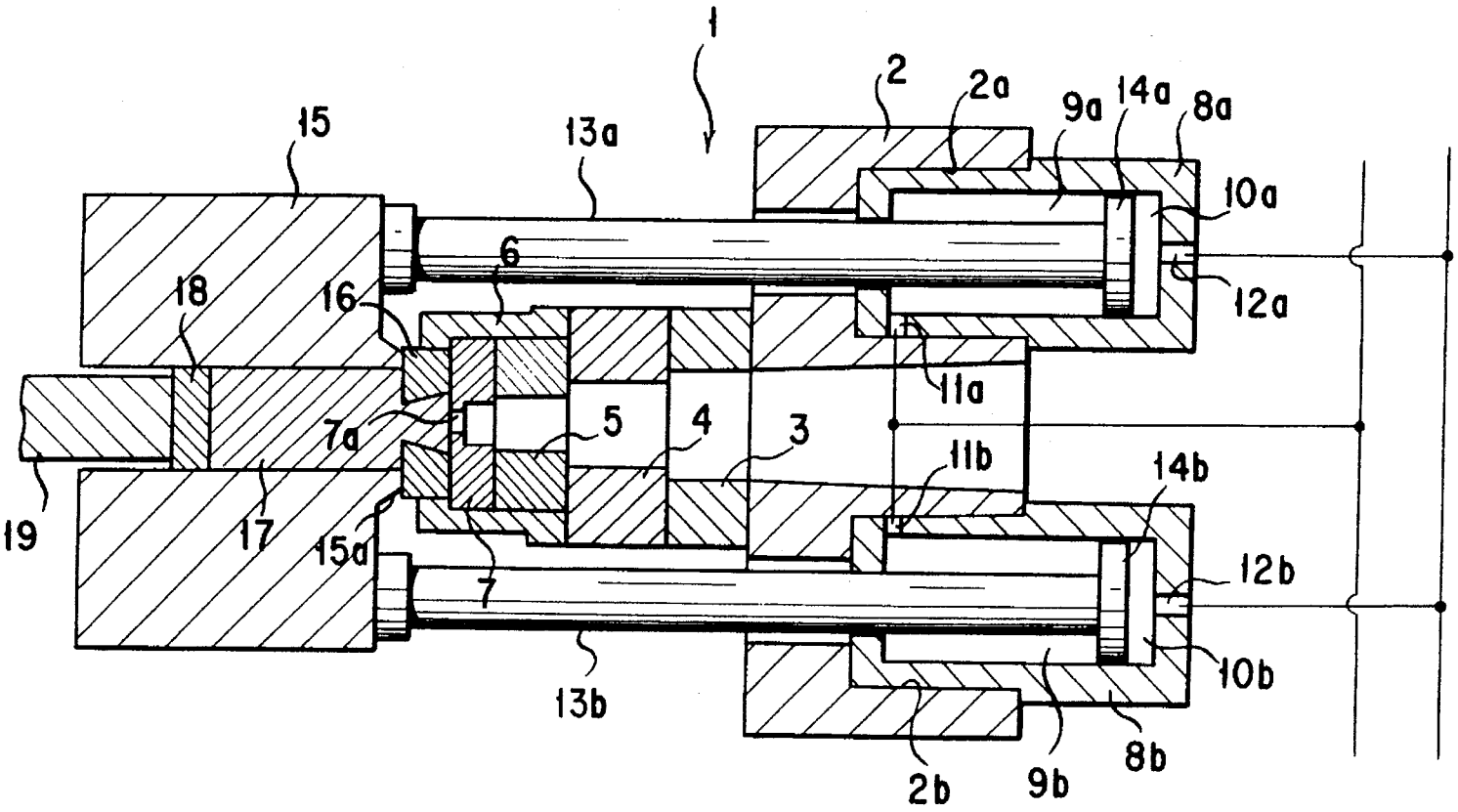
FIG. 1 (PRIOR ART)
FIG. 1 is a cross sectional view illustrating a conventional extruder.
Figure 2:
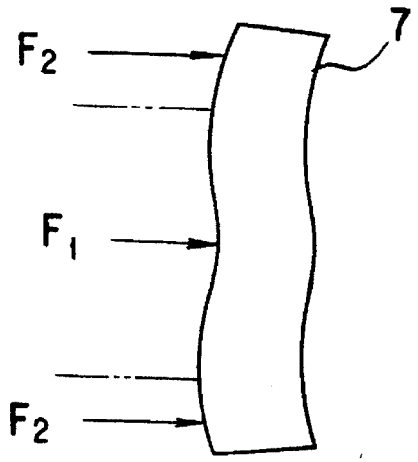
FIG. 2 is a schematic explanatory diagram of the state of deformation occurring in a die during the initial stage of extrusion in the conventional extrusion process.
Figure 3:
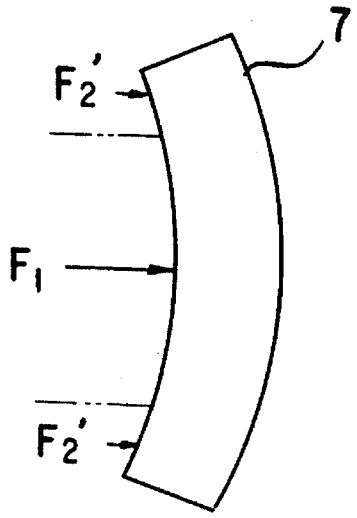
FIG. 3 is a schematic explanatory diagram of the state of deformation occurring in a die during the last stage of extrusion 10 in the conventional extrusion process.

In an extruder 1 shown in FIG. 1, when a stem 19 is pressed against a billet 17, for example, the friction which consequently occurs between the billet 17 and a container 15 gives rise to shear resistance in the container 15. This shear resistance in the container prompts transmission of part of the pressing force of the stem 19 via the billet 17 to the container 15 and proportionately adds to the sealing force produced by the container 15. Since the shear resistance in the container is directly proportional to the length of the billet 17, this shear resistance gains in magnitude and the force transmitted from the stem 19 to the container 15 proportionately increases during the initial stage of extrusion. Since the sealing force produced by the container 15 consequently increases, the retaining force $F_2$exerted on the peripheral part of a die 7 is increased as shown in FIG. 2 during the initial stage of extrusion. This retaining force sequentially decreases in proportion as the length of the billet 17 in the container 15 decreases in consequence of the progress of extrusion. During the final stage of extrusion, the sealing force by the container 15 decreases and the retaining force on the peripheral part of the die 7 proportionately decreases as illustrated in FIG. 3 by $F_2'$.

During the initial stage of extrusion, since the retaining force $F_2$ exerted on the peripheral part of the die 7 is large and different only slightly from the pressing force $F_1$ exerted on the billet, the pressing force $F_1$ exerted on the billet does not cause a very large compressive deformation in the central part of the die 7 as illustrated in FIG. 2 and, therefore, the dimensions of the orifice 7*a* of the die 7 are scarcely changed. When the retaining force $F_2$ exerted on the peripheral part of the die 7 is decreased in proportion as the extrusion is advanced, however, the compressive deformation caused in the central part of the die 7 by the pressing force $F_1$ exerted on the billet is increased as shown in FIG. 3 and the dimensions of the orifice 7*a* of the die 7 is proportionately decreased. As a result, the profiles of aluminum exhibit a sequential decrease in section thickness from the beginning to the end of the operation of extrusion.

In other words, part of the pressing force of the stem 19 acts as a container-sealing force on the die 7 and brings about a change in the retaining force exerted on the peripheral part of the die. Since the magnitude of the sealing force so acting on the die 7 is in direct proportion to the length of the billet and, what is more, the sealing force generated by the container cylinders 8*a* and 8*b* is constant, the sealing force on the whole is large during the initial stage of extrusion and is decreased in proportion as the extrusion is advanced. Therefore, the retaining force exerted on the peripheral part of the die 7 is varied in a similar pattern. To be specific, the articles produced by the extrusion exhibit a gradual decrease in section thickness from the leading end to the trailing end thereof because the compressive deformation caused in the central part of the die 7 which is not very large during the initial stage of extrusion is sequentially increased in proportion as the extrusion is advanced.

Figure 4:
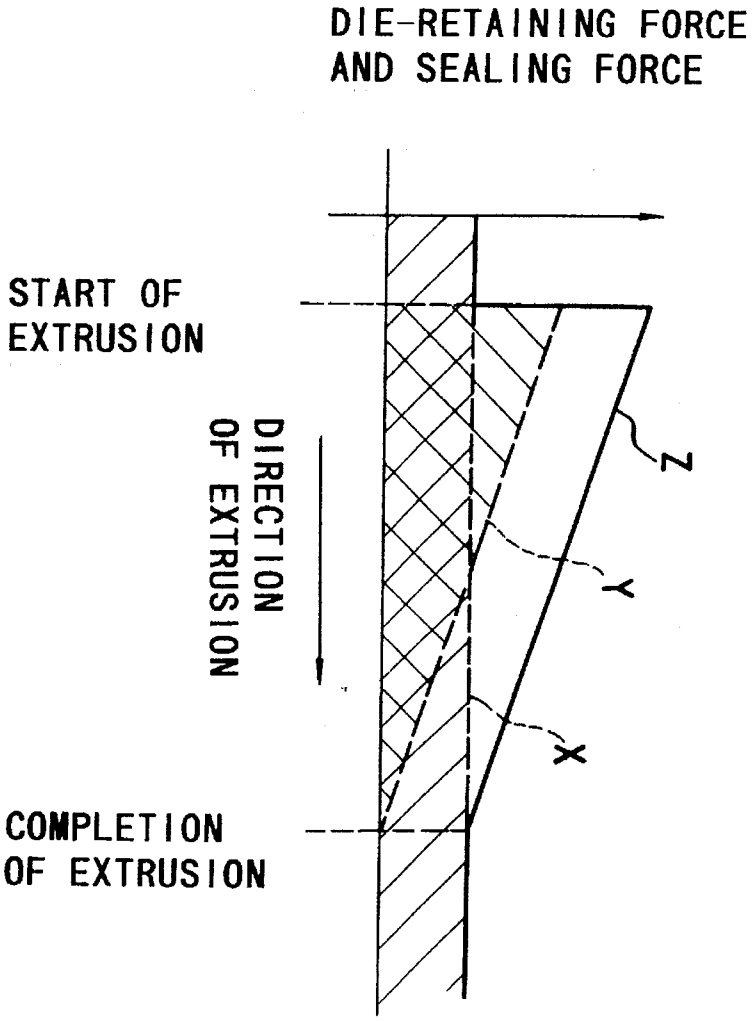
FIG. 4 is a graph showing the time-course change of sealing force in the conventional extruder.

Diagrammatically, FIG. 4 depicts what has been described thus far. Since the sealing force X generated by the container cylinders 8*a* and 8*b* is constant and the sealing force Y generated by the shear resistance arising inside the container from the friction force between the billet 17 and the container 15 is maximized at the beginning of extrusion and zero at the end of extrusion, the retaining force Z exerted on the peripheral part of the die is maximized at the beginning of extrusion, decreased sequentially in proportion as the extrusion is advanced, and turned into the sealing force by the container cylinders 8*a* and 8*b* at the end of the extrusion.

In the method for controlling the die-retaining force of an extruder in accordance with the present invention, the container cylinders are caused to impart to the container the force directed away from the die so as to be sequentially decreased during the first half period of extrusion and the container cylinder is caused to impart to the container the force directed toward the die so as to be sequentially increased during the last half period of extrusion. Since the sealing force generated by the container cylinders, therefore, has a minus magnitude during the first half period of extrusion and a plus magnitude during the last half period of extrusion, the sealing force which is generated by the shear resistance arising inside the container from the friction force between the billet 17 and the container 15 is cancelled by said sealing force and thus the retaining force exerted on the peripheral part of the die is substantially kept constant. As a result, the variation of the extruded articles in section thickness due to the variation of the retaining force working on the peripheral part of the die can be minimized.

Now, the method for controlling the die-retaining force of an extruder in accordance with the present invention will be described specifically below with reference to the accompanying drawings.

Figure 5:
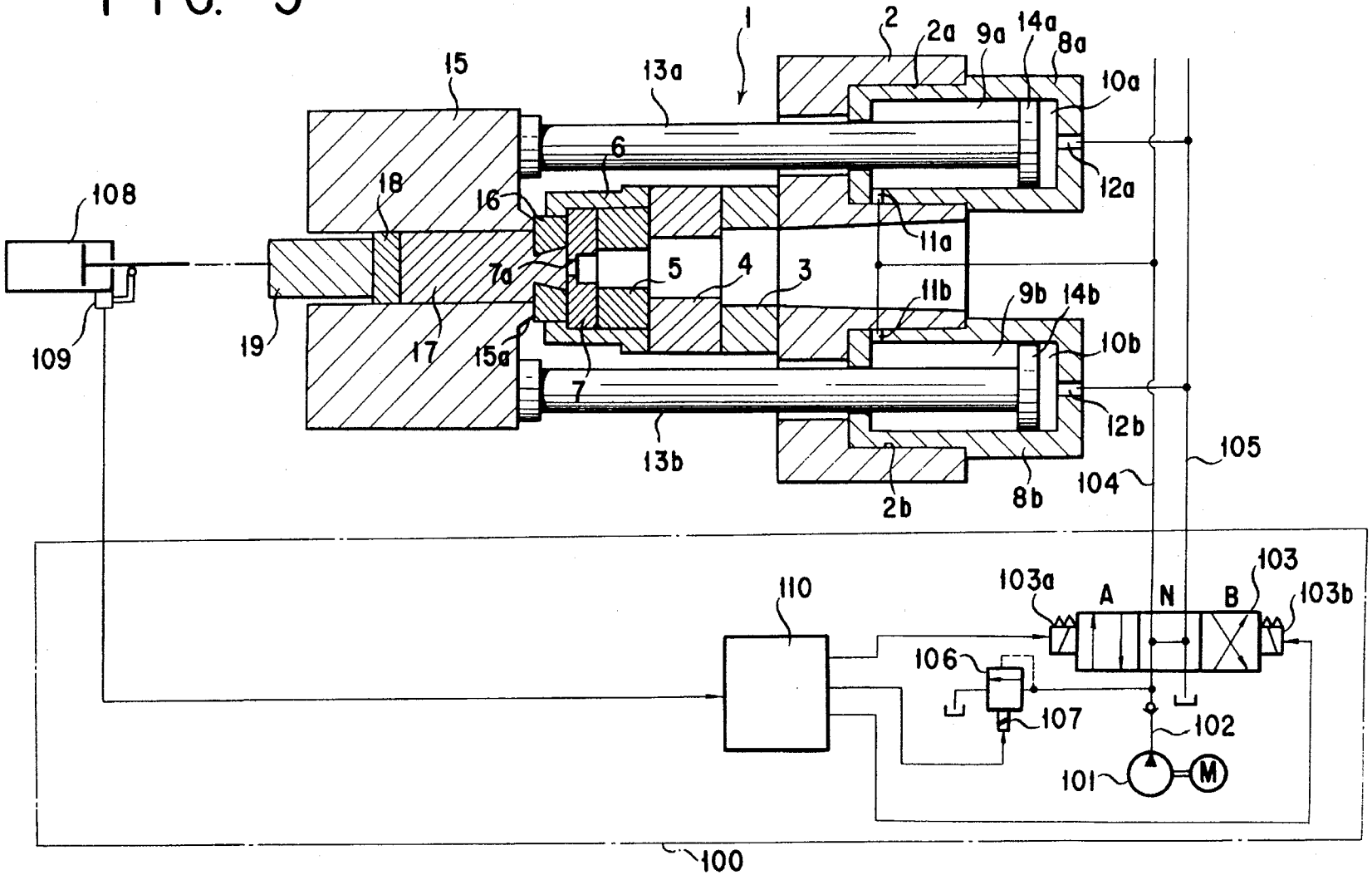
FIG. 5 is a cross sectional view illustrating one embodiment of an apparatus for working the method of the present invention.

In FIG. 5, the numeral 100 indicates the essential parts of the control system according to the present invention. The extruder 1 is same as the conventional extruder illustrated in FIG. 1 and has already been explained hereinbefore.

As illustrated in FIG. 5, a discharge line 102 of a hydraulic pump 101 is controlled so as to be connected to a first line 104 or a second line 105 by means of a selector valve 103. The first line 104 is connected to the first chambers 9*a* and 9*b* via ports 11*a* and 11*b* and the second line 105 to the second chambers 10*a* and 10*b* via ports 12*a* and 12*b* respectively of the container cylinders 8*a* and 8*b*. To the discharge line 102 a variable relief valve 106 is connected. The selector valve 103 mentioned above is a solenoid selector valve which is made by the excitation of a first solenoid 103*a* to assume a first position A for connecting the discharge line 102 to the first line 104 and by the excitation of a second solenoid 103*b* to assume a second position B for connecting the discharge line 102 to the second line 105. This solenoid selector valve 103 is controlled by a controller 110. The variable relief valve 106 is adapted to be fixed at a pressure which is proportionate to the magnitude of an electric current supplied to a solenoid 107.

A stem cylinder 108 serving to push the stem 19 forward is provided with a stroke sensor 109. The stroke detected by this sensor 109 is inputted to the controller 110 and consequently the controller 110 supplies relevant control currents to the first and second solenoids 103*a* and 103*b* and the solenoid 107. Specifically, the controller 110 discerns the position of the stem 19 in the light of the stroke of the stem cylinder 108 and then, based on the position of the stem 19, supplies control currents to the first and second solenoids 103*a* and 103*b* and the solenoid 107 so as to conform to a component operational pattern committed to memory in advance.

Now, the operation of the apparatus illustrated in FIG. 5 will be described below.

When the stem 19 is inserted in the container 15, the controller 110 transmits an excitation signal to the first solenoid 103*a* and, at the same time, supplies an electric current to the solenoid 107, with the result that the pressure of the hydraulic oil discharged from the pump 101 will be set by the variable relief valve 106 at the prescribed pressure $P_1$ and, at the same time, the selector valve 103 will be caused to assume the first position A, and the discharge line 102 will be connected to the second line 104. With the apparatus in the state ensuant on the preceding operation, the pressure oil discharged from the pump 101 is supplied via the selector valve 103 and the first line 104 to the first chambers 9*a* and 9*b* of the container cylinders 8*a* and 8*b* to move the pistons 14*a*, 14*b* therein and the piston rods 13*a*, 13*b* attached thereto forward and the container 15 is pulled in the direction of the container cylinders 8*a* and 8*b*. As a result, the container 15 is pressed against the spreader 16 so as to seal the gap between the inner circumferential edge part 15*a* of the container 15 and the spreader 16 and, at the same time, retain the peripheral part of the die 7.

When the dummy block 18 is pressed against the billet 17 by the forward movement of the stem 19 and consequently caused to assume a position for starting the work of extrusion, the controller 110 demagnetizes the first solenoid 103*a* and outputs an excitation signal to the second solenoid 103*b* and induces the selector valve 103 to assume the second position B. When the selector valve 103 is caused to assume the second position B and the discharge line 102 is connected to the second line 105, the pressure oil discharged from the pump 101 is supplied to the second chambers 10*a* and 10*b* of the container cylinders 8*a* and 8*b*. In the meanwhile, the controller 110 slightly increases the magnitude of an electric current supplied to the solenoid 107 and exalts preset pressure to $P_2$ and, at the same time, sequentially decreases the magnitude of electric current to sequentially lower the set pressure $P_2$ substantially to zero in proportion as the stem 19 will be moved to the intermediate position of the stroke thereof. As a result, the container 15 receives a force directed away from the die 7. The magnitude of this force is maximized in the beginning of extrusion and sequentially decreased in proportion as the extrusion is advanced. When the stem 19 has assumed a substantially intermediate position in the stroke of extrusion, the controller 110 demagnetizes the second solenoid 103*b*, outputs an excitation signal to the first solenoid 103*a*, and makes the selector valve 103 assume the first position A, with the result that the pressure oil discharged from the pump 101 will be supplied to the first chambers 9*a* and 9*b* of the container cylinders 8*a* and 8*b*. In the meanwhile, the controller 110 sequentially increases the magnitude of electric current supplied to the solenoid 107 up to the initial level and sequentially elevates the pressure of hydraulic oil to the first chambers 9*a* and 9*b* from zero to the preset pressure and causes the container cylinders 8*a* and 8*b* to impart to the container 15 a force tending to press the die 7. This pressing force is gradually increased until the stem 19 reaches the position of the extrusion limit.

When the stem 19 eventually reaches the position of the completion of extrusion, the selector valve 103 assumes the neutral position N and, at the same time, the magnitude of electric current supplied to the solenoid 107 decreases to zero, with the result that the set pressure will fall to zero.

Figure 6:
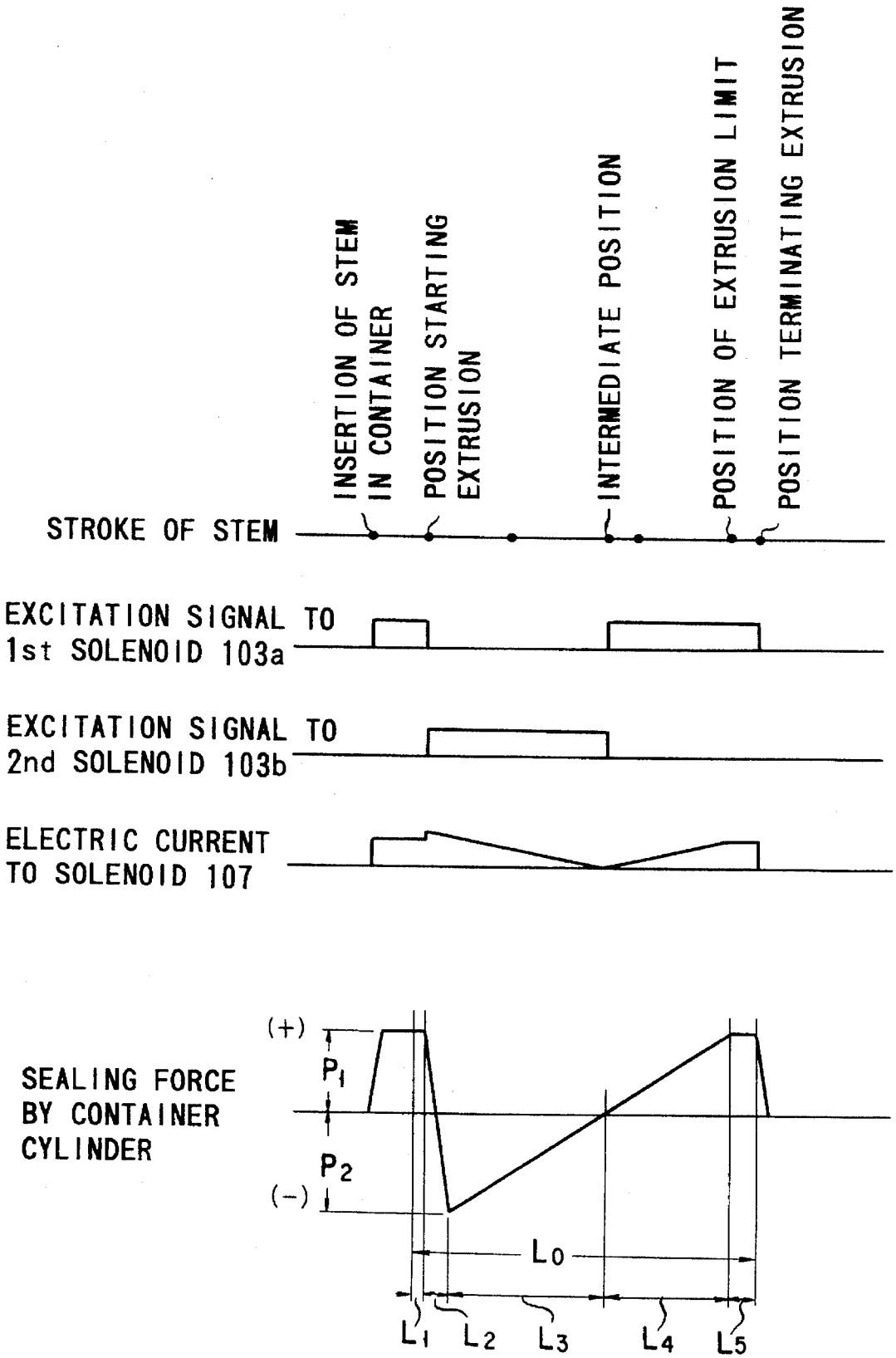
FIG. 6 is a graph showing the relation between the timing of the operation of the apparatus shown in FIG. 5 and the sealing force produced by a container cylinder.
Figure 7:
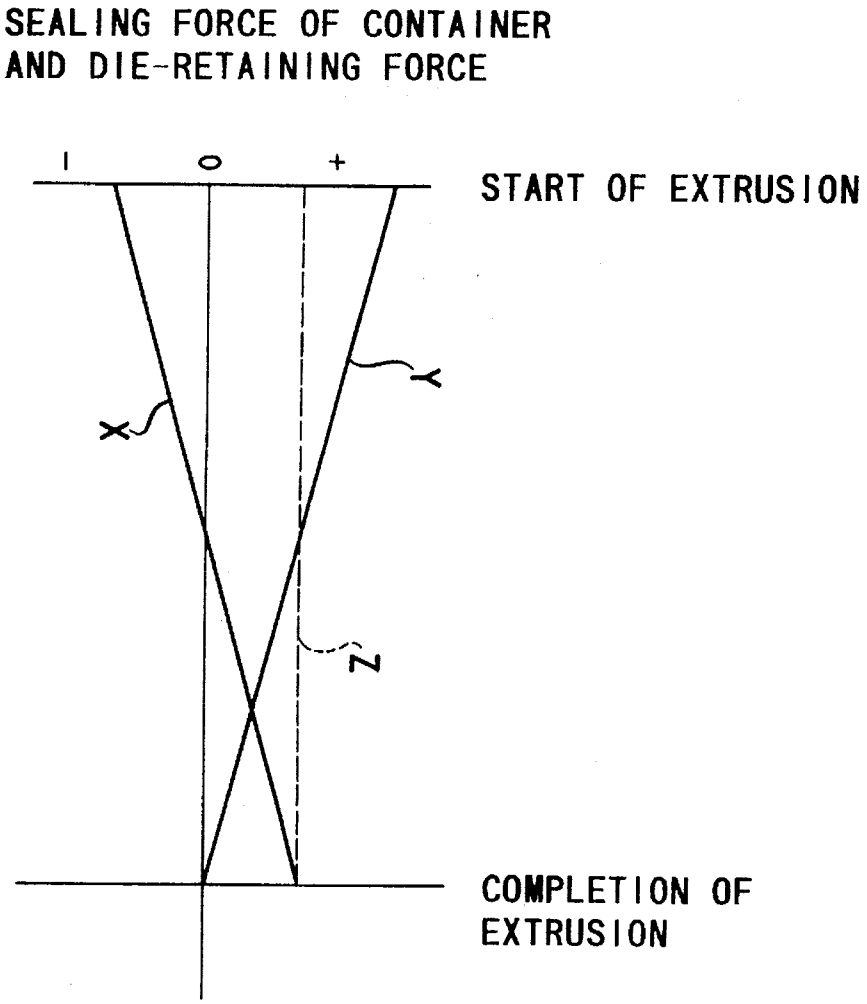
FIG. 7 is a graph showing the change in the sealing force of the container during the course of extrusion according to the present invention.

By controlling the container cylinders 8*a* and 8*b* as described above, the sealing force X generated between the container 15 and the spreader 16 by means of the container cylinders 8*a* and 8*b* is sequentially decreased to a minimum value (minus side) in the beginning of extrusion and thereafter sequentially increased to a constant value as illustrated in FIG. 6. As a result, the retaining force Z exerted on the peripheral part of the die 7 is substantially constant from the first half period of extrusion through the completion of extrusion as illustrated in FIG. 7. Specifically, the sealing force Y generated between the container 15 and the spreader 16 by the shear resistance of the container arising from the friction force between the billet 17 and the container 15 is sequentially decreased from the position starting extrusion to the position completing extrusion and the sealing force Z generated by the container cylinders is sequentially increased from a minus level to a plus level. Thus, the force Z for retaining the peripheral part of the die is substantially constant.

In the embodiment cited above, the sealing force X generated between the container 15 and the spreader 16 by means of the container cylinders 8*a* and 8*b* and the retaining force Z exerted on the peripheral part of the die 7 are controlled on the basis of the stroke of the stem cylinder 108. Optionally, the time for switching the selector valve 103 and the magnitude of the pressure of the hydraulic oil discharged from the pump 101 may be set in advance as in accordance with the operating speed of the stem during the course of extrusion so that the control of the forces X and Z mentioned above will be carried out based on such preset values.

Now, a practical experiment carried out on this invention will be described below.

In the apparatus shown in FIG. 5, the die assembly fulfilling the dimensional specifications, 185 mm for the inner diameter of a container, 224 mm for the outside diameter of a retaining part (inner circumferential edge part 15*a* of the container), 12,528 $mm^2$ for the area of the retaining part, 178 mm for the diameter and 430 mm for the length respectively of a billet, and $1.5\pi DL \pm W$ for the friction force was set up and used for extrusion under the conditions of $P_1$=175 kg/$cm^2$, $P_2$=177 kg/$cm^2$, $L_0$=388 mm, $L_1$=5 mm, $L_2$=27 mm, $L_3$=171 mm, $L_4$=170 mm, and $L_5$=15 mm in FIG. 6, with the sealing force X by the container cylinders fixed in one test run and varied in another test run. The data obtained in the experiment on the retaining force exerted on the peripheral part of the die were as follows.

TABLE 1

| | Initial retaining force (ton) | Final sealing force (ton) | Difference of sealing force (ton) | Difference of sealing pressure (kg/$cm^2$) |
|---|---|---|---|---|
| Sealing force fixed (conventional) | 457 | 132 | 325 | 26 |
| Sealing force varied (present invention) | 178 | 132 | 46 | 3.7 |
| Difference | 279 | Zero | 279 | 22.3 |

Figure 8:
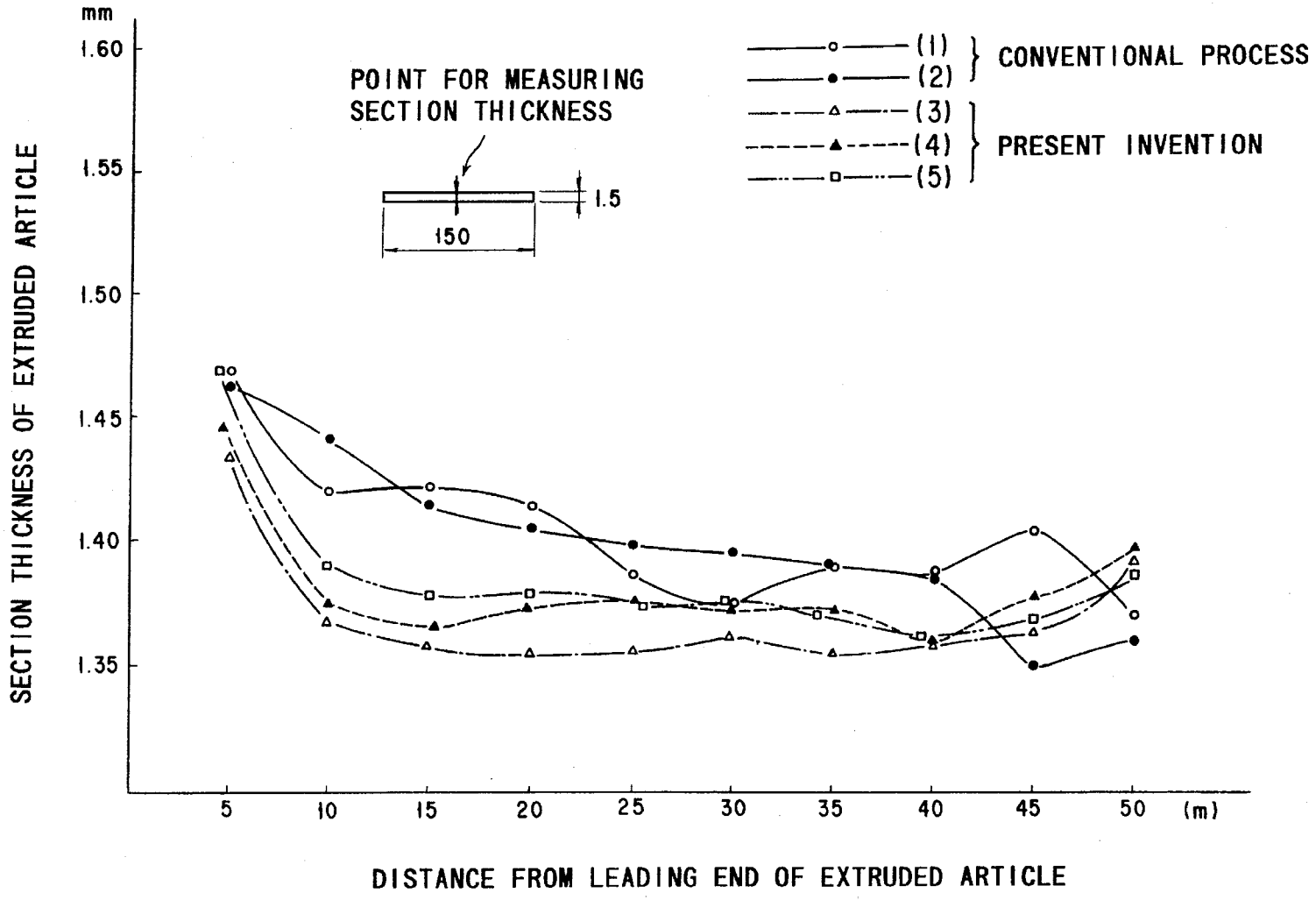
FIG. 8 is a graph showing the change in section thickness of section articles produced by extrusion according to the present invention.

The extruded articles exhibited changes in section thickness as shown in FIG. 8. The data inicate that the extruded articles produced in accordance with the present invention had smaller changes in section thickness.

In the embodiment cited above, the container 15 is alternately moved away from and toward the die 7 by using a pair of container cylinders 8*a* and 8*b* and supplying the pressure oil discharged from the pump 101 alternately to the first chambers 9*a*, 9*b* and the second chambers 10*a*, 10*b* thereby expanding and retracting the piston rods 13*a* and 13*b*, and the container sealing force is consequently increased to a plus value and decreased to a minus value. Optionally, the number of container cylinders to be installed may be increased to three or more. It is also possible to install one pair of first container cylinders adapted to move alternately the container 15 toward and away from the die 7 and a pair of second container cylinders adapted to move the container 15 only away from the die 7. In this case, it is desirable to install the pair of first container cylinders on one of the diagonal lines of the platen 2 and the pair of second container cylinders on the other diagonal line.

Figure 9:
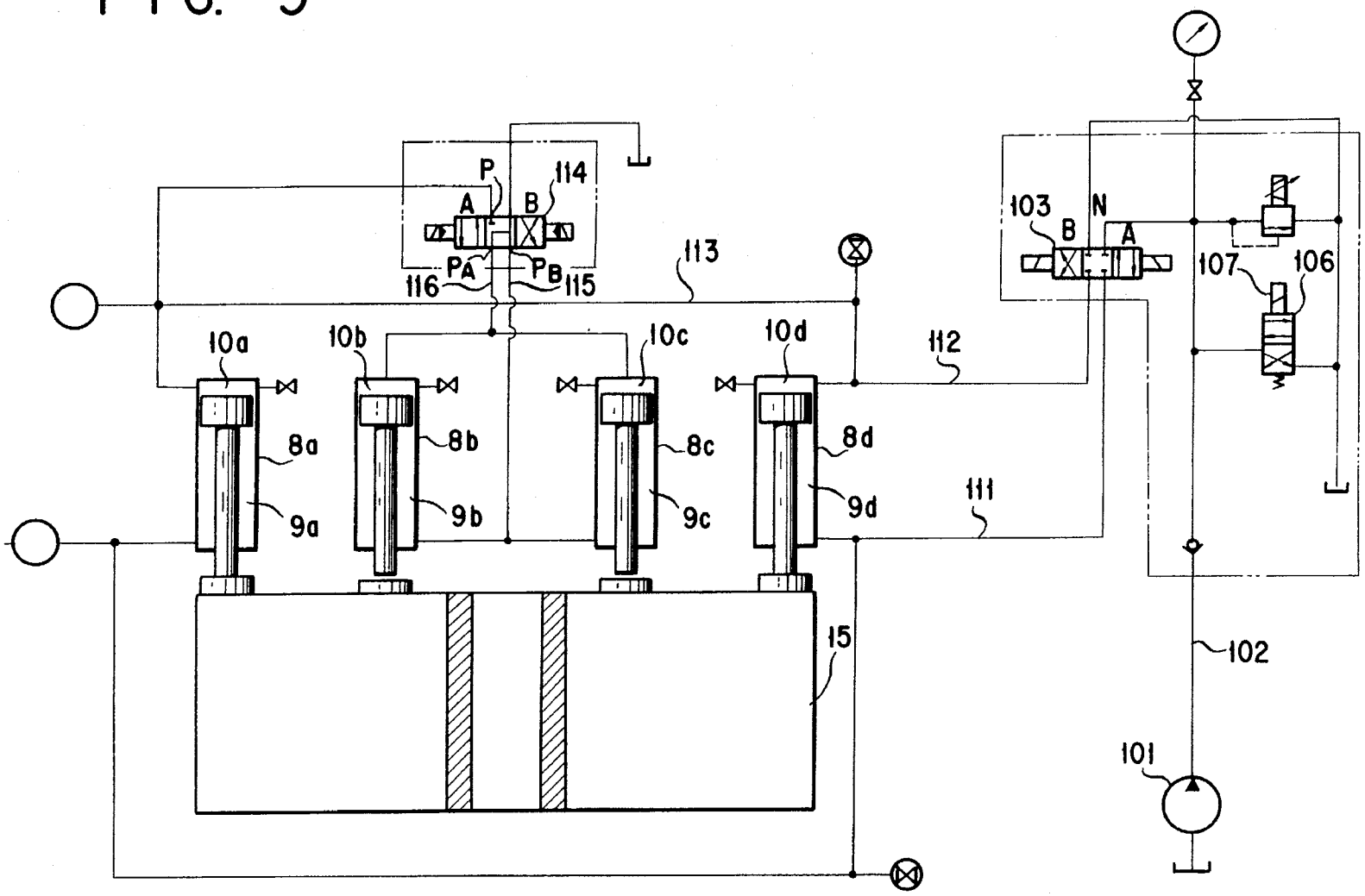
FIG. 9 is a schematic diagram illustrating another embodiment of the hydraulic circuit of the present invention embodied in an extruder using four container culinders.

For example, as illustrated in FIG. 9, one pair of first container cylinders 8*a*, 8*d* and one pair of second container cylinders 8*b*, 8*c* are installed, a selector valve 103 is connected on the outlet side thereof to the first chambers 9*a*, 9*d* and the second chambers 10*a*, 10*d* of the first container cylinders 8*a*, 8*d* respectively via a first and second lines 111 and 112, a third line 113 connected to the second chambers 10*a*, 10*d* is connected to a pump port P of an auxiliary selector valve 114, and a first and second actuator port PB and PA are connected to the first chambers 9*b*, 9*c* and the second chambers 10*b*, 10*c* of the pair of second container cylinders 8*b*, 8*c* respectively via a fourth and fifth lines 115 and 116.

Now, the operation of the apparatus illustrated in FIG. 9 will be described below.

First, the container 15 is moved toward the die and the sealing force by the container cylinders 8*a* and 8*d* is increased to a plus value by setting the selector valve 103 at the first position A thereby causing the pressure oil discharged from the pump 101 to be supplied to the first chambers 9*a* and 9*d* of the first container cylinders 8*a* and 8*d*.

Then, in the beginning of extrusion the container 15 is moved away from the die and the sealing force by the container cylinders is decreased to a minus value by setting the selector valve 103 at the second position B and, at the same time, setting the auxiliary selector valve 114 at the first position A thereby causing the pressure oil discharged from the pump 101 to be supplied to the second chambers 10*a* to 10*d* of the first and second container cylinders 8*a* to 8*d*. When the stem has assumed a substantially intermediate position in the stroke of extrusion, the selector valve 103 assumes the first position A and, at the same time, the auxiliary selector valve 114 assumes the second position B. The timing for switching the selector valves 103 and 114 and the pressure of the hydraulic oil discharged from the pump 101 are controlled by a controller (not shown) in the same manner as mentioned hereinbefore with reference to FIGS. 5 and 6.

In the apparatus of FIG. 9, the discharge line 102 of the hydraulic pump 101 is also provided with the variable relief valve 106 with solenoid 107, which functions as described hereinbefore.

In the arrangement described above, since the container is pressed by four container cylinders when the container 15 is moved away from the die, the pressing force can be increased and the container 15 can be evenly pushed and the sealing force can be uniformized in the circumferential direction. Moreover, the pair of second container cylinders 8*b* and 8*c* do not need to be connected to the container 15. This contributes to simplify the construction of attachment.

Now, the control of the sealing pressure of the container 15 by means of the container cylinders will be described in detail below.

In the plastic fabrication, the extruding force $F_0$ existing at the end of extrusion is expressed as follows:

$$F_0=\pi R^2\rho \log_e\delta \quad (1)$$

wherein "R" stands for the inner radius of container (mm), "ρ" for the resistance to deformation (kgf/mm$^2$), and "δ" for the ratio of extrusion.

The extruding force "F" necessary for the extrusion of the billet having the length of "l" is expressed as follows:

$$F=F_0e^{2fl/R} \quad (2)$$

wherein "$F_0$ 38 stands for the extruding force "F" which exists where "l" =0, namely at the end of the extrusion or in the absence of friction, "l" for the length of billet (mm), and "f" for the friction coefficient between the billet and the container.

From the equations (1) and (2), the following equation is derived:

$$F=\pi R^2\rho \log_e\delta e^{2fl/R} \quad (3)$$

From the equations (1) and (3), the following equation representing the sealing force ($F-F_0$) due to the shear resistance inside the container can be derived.

$$F-F_0=\pi R^2\rho \log_e\delta(e^{2fl/R}-1) \quad (4)$$

Incidentally, the force at the beginning of extrusion (at which the length of the billet is unity, "l") and the force at the end of extrusion can be easily calculated by measuring the pressures of the stem cylinder at the relevant times during the course of actual extrusion. The aforementioned equation (1) can be rewritten as follows. Thus, the resistance to deformation "ρ" can be determined by the following equation (5) when the magnitude of "$F_0$" and the ratio of extrusion "δ" are known.

$$\rho=F_0/\pi R^2\times 1/\log_e\delta \quad (5)$$

By the same token, the knowledge of "$F_0$" and "F" allows the friction coefficient f to be calculated from the equation (2), i.e. $F/F_0=e^{2fl/R}$, as follows.

$$f=\log_e(F/F_0)xR/2l \quad (6)$$

Then, in the actual extrusion, the total sealing force "$Y_3$" is given by the equation: $Y_3=Y_1+Y_2$, wherein "$Y_1$" stands for the sealing force arising from the shear resistance generated inside the container and "$Y_2$ "for the sealing force produced by the container cylinders. This total sealing force "$Y_3$" constitutes itself the retaining force exerted on the peripheral part of the die.

Here, the sealing force $Y_1(F-F_0)$ due to the shear resistance offered inside the container is found from the equation (4) as $Y_1=\pi R^2\rho\log_e\delta(e^{2fX/R}-1)$. The sealing force "$Y_2$" produced by the container cylinders, therefore, is found as follows:

$$Y_2=Y_3-\pi R^2\rho \log_e\delta(e^{2fX/R}-1) \quad (7)$$

wherein "x" stands for a distance between the die and the position of the leading end of the ram or stem (length of billet, l=x).

In the equation (7) given above, if the total sealing force "$Y_3$" is set at a fixed value, the magnitude of "$Y_3$" is constant and the term of $\pi R^2\rho\log_e{}^{\delta}$ possesses an intrinsic value. This equation (7), accordingly, permits the sealing force "$Y_2$" produced by the container cylinders to be calculated based on the value "x" of the distance between the die and the leading end of ram. The knowledge of this sealing force "$Y_2$", therefore, permits the total sealing force "$Y_3$", namely the retaining force exerted on the peripheral part of the die, to be kept constant by controlling the hydraulic pressure exerted to the container cylinders in accordance with the ram position.

Let "c" stand for the value of "x" satisfying $Y_2=0$ in the equation (7), then the expression x>c represents a reverse sealing and the expression x<c a normal sealing. The term "intermediate position" as used herein means the position where the value of "x" satisfies $Y_2=0$ in the aforementioned equation (7).

The discussion given thus far boils down to the conclusion that the extruding force at the end of extrusion and the extruding force at the beginning of extrusion are found from the relevant values of pressure produced by the stem cylinder, the friction coefficient "f" and the resistance to deformation "ρ" are found by the calculation using the found values of extruding force, and the sealing force arising from the resistance to friction offered inside the container is found from the extruding force at the end of extrusion and the extruding force at the beginning of extrusion.

By the substitution of these values in the following equation, therefore, the determination of the position of the leading end of ram by detecting the stroke thereof suffices to control the sealing force produced by the container cylinder.

$$Y_2=\pi R^2\rho \log_e\delta(e^{2fX/R}-1)-Y_3$$

wherein "$Y_2$ "stands for the sealing force produced by the container cylinder, "R" for the radius of a billet, "δ" for the extrusion ratio, "x" for the distance between the die and the leading end of the ram, and "$Y_3$" for the total sealing force.

While certain specific embodiments have been disclosed herein, the invention may be embodied in other specific forms without departing from the spirit or essential characteristics thereof. The described embodiments are therefore to be considered in all respects as illustrative and not restrictive, the scope of the invention being indicated by the appended claims rather than by foregoing description and all changes which come within the meaning and range of equivalency of the claims are, therefore, intended to be embraced therein.

What is claimed is:

1. In the operation of an extruder adapted to retain a die with a container actuated by a container cylinder and effect extrusion of a billet by forcing the billet placed in said container through said die by means of a stem, a method for controlling the die-retaining force of said extruder which comprises:

causing said container cylinder to impart to said container a force directed away from said die so as to be sequentially decreased during a first half period of extrusion; and causing said container cylinder to impart to said container a force directed toward said die so as to be sequentially increased during a last half period of extrusion.

2. A method according to claim 1, wherein said container cylinder is controlled such that after said stem has reached a position for starting extrusion, hydraulic oil is supplied to a second chamber on a free end side of a piston of said container cylinder so as to sequentially decrease the hydraulic pressure thereof, and after said stem has reached an intermediate position between the position for starting extrusion and a position for terminating extrusion, said hydraulic oil is supplied to a first chamber on a piston rod side of said container cylinder so as to sequentially increase the pressure thereof.

3. A method according to claim 1, which further comprises a step of detecting a stroke of said stem to determine the position of the stem in the container.

4. A method for controlling the die-retaining force of an extruder adapted to retain a die with a container actuated by a container cylinder and effect extrusion of a billet by forcing the billet placed in said container through said die by means of a stem, the method comprising actuating the container cylinder by supplying a hydraulic oil to said container cylinder in such a manner that (a) when said stem has reached a position for starting extrusion, hydraulic oil is supplied to a second chamber on a free end side of a piston of said container cylinder and the hydraulic pressure thereof is gradually decreased;

(b) when said stem has reached a position between the position for starting extrusion and a position for terminating extrusion, said hydraulic oil is supplied to a first chamber on a piston rod side of said container cylinder and the hydraulic pressure thereof is gradually increased until said stem reaches a position of extrusion limit; and (c) the pressure of said hydraulic oil supplied to the first chamber of said container cylinder is maintained until said stem reaches the position for terminating extrusion.

5. A control system for an extrude adapted to retain a die with a container actuated by a container cylinder and effect extrusion of a billet by forcing the billet placed in said container through said die by means of a stem, comprising in combination:

a hydraulic pump for delivering a pressure oil to said container cylinder;

a piston movable within said container cylinder and connected by a piston rod to said container to exert a force on said container selectable between toward or away from said die;

means for switching said pressure oil to a first chamber on a piston rod side of said container cylinder or to a second chamber on a free end side of said piston of said container cylinder;

means for detecting a stroke of said stem slidably moving in said container;

means for controlling the timing of switching the supply of pressure oil and a hydraulic pressure thereof in response to the stroke of said stem during the extrusion.

6. A system according to claim 5, wherein said said extruder comprises a pair of container cylinders.

7. A system according to claim 5, wherein said extruder comprises a pair of first container cylinders each having a piston rod connected to said container and a pair of second container cylinders each having a piston rod whose one end is disposed near said container.

* * * * *